US009229432B2

(12) United States Patent
Ruefenacht et al.

(10) Patent No.: US 9,229,432 B2
(45) Date of Patent: Jan. 5, 2016

(54) FAST CORRECTION MECHANISM FOR TIMEPIECES

(71) Applicant: ETA SA Manufacture Horlogere Suisse, Grenchen (CH)

(72) Inventors: Christian Ruefenacht, Bienne (CH); Raphael Courvoisier, Corcelles (CH); Antonio Merino, Moutier (CH); Giuseppe Cappadona, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/708,821

(22) Filed: May 11, 2015

(65) Prior Publication Data

US 2015/0331392 A1 Nov. 19, 2015

(30) Foreign Application Priority Data

May 14, 2014 (EP) ..... 14168333

(51) Int. Cl.
*G04B 19/25* (2006.01)
*G04B 27/06* (2006.01)
*G04B 18/02* (2006.01)

(52) U.S. Cl.
CPC ..... *G04B 18/02* (2013.01); *G04B 19/25* (2013.01); *G04B 27/06* (2013.01)

(58) Field of Classification Search
CPC .... G04B 11/003; G04B 11/008; G04B 19/25; G04B 19/253; G04B 27/04; G04B 27/06; G04B 27/065
USPC ..... 368/34–36, 191, 192, 194, 196
See application file for complete search history.

(56) References Cited

U.S. PATENT DOCUMENTS 3,844,107 A * 10/1974 Guyot ..... G04B 27/005 368/192
3,892,067 A 7/1975 Meylan-Piguet
3,983,691 A * 10/1976 Schaller ..... G04B 27/02 368/31
6,295,249 B1 * 9/2001 Takahashi ..... G04B 27/06 368/190

(Continued)

FOREIGN PATENT DOCUMENTS

CH 589 880 7/1977
EP 1 666 991 A1 6/2006

(Continued)

OTHER PUBLICATIONS

European Search Report issued Feb. 18, 2015 in European Application 14168333.4, filed on May 14, 2014 (with English translation).

*Primary Examiner* — Vit W Miska
(74) *Attorney, Agent, or Firm* — Oblon, McClelland, Maier & Neustadt, L.L.P.

(57) ABSTRACT

A lever for transmitting motion from an input wheel set pivoting about a first axis on a pivoting plate of the lever, to a receiver wheel set, the input wheel set permanently transmitting its motion to an output wheel set carried by the plate and pivoting under the action of the input wheel set about a second axis whose angular position is variable relative to the first axis, and the lever includes a first friction connection between a first friction surface of the input wheel set and a second friction surface of the plate, this first friction connection is weaker or stronger than a second friction connection between a third friction surface of the output wheel set and a fourth friction surface of the plate included in the lever.

19 Claims, 4 Drawing Sheets

(56) References Cited

U.S. PATENT DOCUMENTS

2008/0259741 A1* 10/2008 Goeller ..... G04B 13/005
368/199
2014/0056112 A1 2/2014 Villaret

FOREIGN PATENT DOCUMENTS

EP 2 701 014 A1 2/2014
FR 2 289 947 5/1976

* cited by examiner

FAST CORRECTION MECHANISM FOR TIMEPIECES

This application claims priority from European Patent Application No. 14168333.4 filed 14 May 2014, the entire disclosure of which is incorporated herein by reference.

FIELD OF THE INVENTION

The invention concerns a timepiece lever including a pivoting plate carrying an input wheel set mounted to pivot about a first pivot axis, and at least one output wheel set pivoting about a second pivot axis remote from said first pivot axis, said input wheel set fully transmitting its motion, directly or indirectly, to said output wheel set which it moves in a pivoting motion about said second pivot axis, said lever including at least a first friction connection between a first friction surface of said input wheel set and a second friction surface of said pivoting plate, and a second friction connection between a third friction surface of said output wheel set and a fourth friction surface of said pivoting plate.

The invention further concerns a fast correction mechanism between a transmitter wheel set arranged to cooperate directly or indirectly with control means, and at least one receiver wheel set, said transmitter wheel set and said at least one receiver wheel set being arranged on a plate comprised in said fast correction mechanism.

The invention also concerns a date mechanism including at least one such fast correction mechanism.

The invention also concerns a timepiece movement including at least one such fast correction mechanism or one such date mechanism.

The invention also concerns a timepiece or watch including at least one such fast correction mechanism or one such date mechanism.

The invention concerns the field of timepiece mechanisms, and more specifically, fast correction mechanisms.

BACKGROUND OF THE INVENTION

This invention concerns watches which require a fast correction mechanism (day, month or other) for certain functions, in particular display functions such as a calendar (annual, perpetual, day/date, or other), or moon phase, tide, AM/PM display or other indicators. A particular example of an annual calendar mechanism is described in Patent No EP1666991B1 in the name of ETA SA.

To set the month, the user generally has to make a correction using the calendar mechanism. In the worst case, this manipulation can prove long and tedious. It may be that a correction of a whole year has to be made. Likewise, if the user makes a mistake during correction, the manipulation has to be repeated. Operating the correction mechanism by means of the calendar mechanism may lead to excessive use and possibly result in malfunctions.

Correction mechanisms often include levers, which are essential components in timepiece movements, enabling a mechanism to switch between several different modes, in general between two distinct positions. A timepiece lever is often accompanied by a return spring to ensure that motion is properly transmitted or support is maintained, depending on the case.

Patent Application No EP 2701014A1 in the name of ROLEX discloses a lever including at least a first element for guiding the rotation of a first wheel set, at least one friction element arranged to cooperate with an at least substantially cylindrical portion of the first wheel set, and at least one elastic element, arranged to elastically return the at least one friction element to a state of cooperation with said first wheel set portion, particularly in contact with this first wheel set portion.

Patent Application No FR2289947A1 in the name of SCHILD discloses a winding and time-set mechanism, with a rotating control stem movable in translation between at least two axial positions, a pull-piece pivoting during the translation of the stem, an intermediate wheel arranged to drive a motion-work wheel when said stem is in said time-set position, and a transmission wheel slidably mounted for engagement or disengagement with a ratchet wheel in the direction of rotation of the stem when the latter is in a winding position. This mechanism includes a transmission pinion, rotating integrally with the stem, but held in a fixed axial position and in permanent mesh with the transmission wheel and the intermediate wheel, and a locking device controlled by the pull-piece, and which holds the transmission wheel disengaged from the ratchet wheel when the stem is in the time-set position, and a connecting element controlled by the stem to uncouple the intermediate wheel from the motion-work wheel when the stem is in the winding position.

Patent No CH589880B4 in the name of SUISSE HORLOGERIE (SSIH) discloses a control mechanism for a watch with two calendar members indicating the day and the date. It includes an axially movable control stem, a pull-piece, a sliding pinion, a sliding pinion lever, and an intermediate wheel. The mechanism includes a single correction lever, which pivots with a friction tight fit on an arbor integral with the intermediate wheel, the arbor is engaged in a hole in a plate, and its position in this hole is determined by an arm of the sliding pinion lever, which cooperates therewith to move the arbor in the hole against a spring. A corrector wheel set is mounted to pivot on the correction lever, so as to be in permanent mesh with the intermediate wheel, and to mesh alternately with one or other of the two calendar members.

SUMMARY OF THE INVENTION

The present invention proposes to overcome the aforecited drawbacks of the prior art, and intends to enable the user to perform a fast correction of a mechanism, in particular of a display mechanism, and more specifically of a date mechanism, so that considerably fewer manual corrections are required to update a timepiece, particularly a watch.

The invention proposes to provide a lever that does not require a return spring to ensure the transmission of motion and is autonomous in its operation.

To this end, the invention concerns a timepiece lever including a pivoting plate carrying an input wheel set mounted to pivot about a first pivot axis, and at least one output wheel set pivoting about a second pivot axis remote from said first pivot axis, said input wheel set fully transmitting its motion, directly or indirectly, to said output wheel set which it moves in a pivoting motion about said second pivot axis, said lever including at least a first friction connection between a first friction surface of said input wheel set and a second friction surface of said pivoting plate, and a second friction connection between a third friction surface of said output wheel set and a fourth friction surface of said pivoting plate, characterized in that one of said first friction connection and second friction connection is weaker than the other.

The invention further concerns a fast correction mechanism between a transmitter wheel set arranged to cooperate directly or indirectly with control means, and at least one receiver wheel set, said transmitter wheel set and said at least one receiver wheel set being arranged on a plate comprised in said fast correction mechanism, characterized in that said fast correction mechanism includes such a lever, mounted to pivot about a first pivot axis, and in that at least one said receiver wheel set pivots about a third pivot axis distinct from said first pivot axis and is arranged to cooperate with at least one said output wheel set carried by said lever which constitutes a sliding friction gear.

The invention also concerns a date mechanism including at least one such fast correction mechanism, characterized in that said first receiver wheel set is a date wheel set or a date correction wheel set, and in that said second receiver wheel set is a month display or a month display correction wheel set.

The invention also concerns a timepiece movement including at least one such fast correction mechanism or one such date mechanism.

The invention also concerns a timepiece or watch including at least one such fast correction mechanism or one such date mechanism.

Owing to the invention, the switching between the various positions is achieved by a control mechanism, or directly by a user through action on a stem, a crown, a push-piece, a pull-piece or similar element, with no risk of damaging a component, due to the presence of at least one friction part in the lever according to the invention. This friction also permits rotation of the mechanism when the lever is in place.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
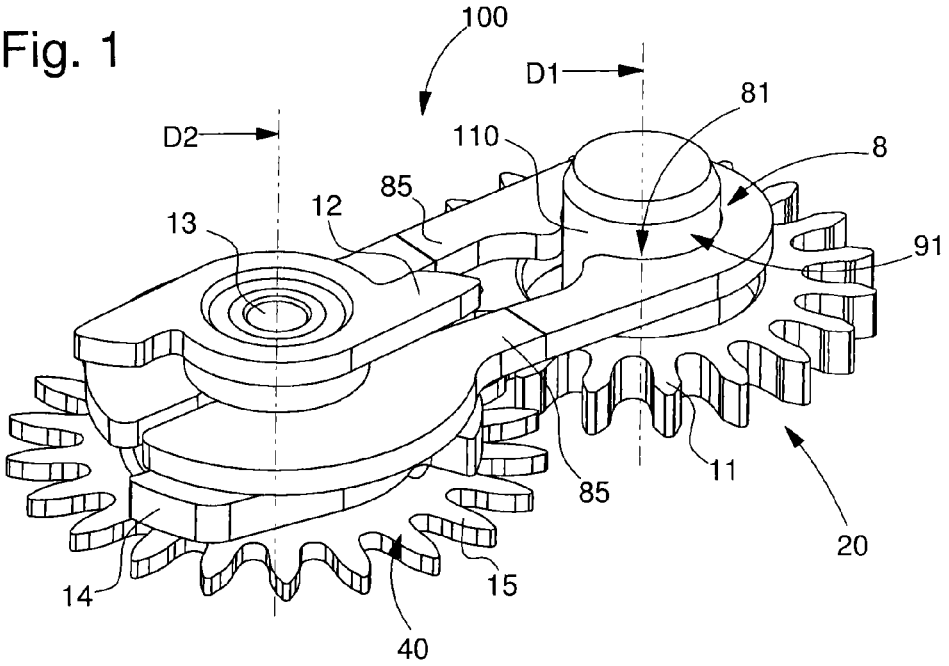
FIG. 1 shows a schematic perspective view of a lever according to the invention, with a pivoting plate carrying an input wheel set meshing with a transmission wheel set, the latter coupled with other control means, here a corrector finger-piece and an intermediate corrector wheel arranged on two different levels and parallel to each other.

The invention concerns the field of timepiece mechanisms, and more specifically control and motion transmission mechanisms. The preferred application of the invention is the correction and updating of display mechanisms.

The invention more particularly concerns a timepiece lever 100 for the transmission of motion between, on the one hand an input wheel set 20 carried by a pivoting plate 8 comprised in said lever 100 and which is mounted to pivot about a first pivot axis D1 on an arbor 110, which is fixed to a plate 19 in the particular illustrated embodiment, and on the other hand at least one receiver wheel set external to lever 100.

Figure 2:
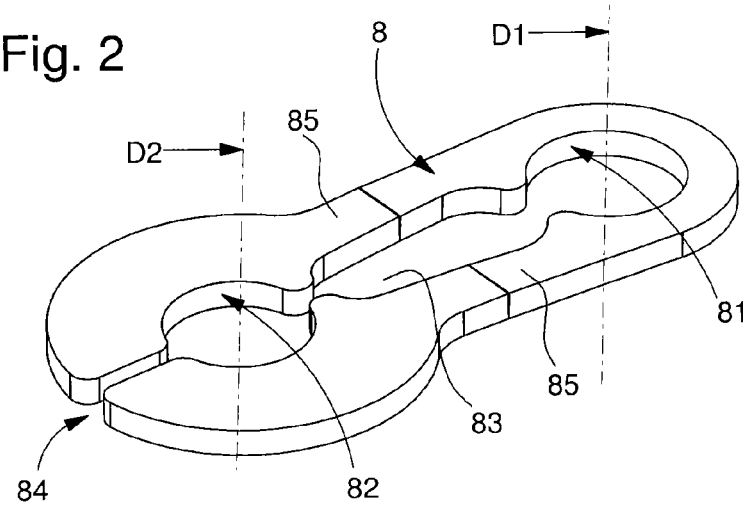
FIG. 2 shows, in the same manner, the pivoting plate including flexible strips on either side of grooves, arranged to clamp the transmission wheel set and/or the input wheel set.

This lever 100 shown in FIGS. 1 and 2 includes, mounted to pivot about a second pivot axis D2 remote from first pivot axis D1, at least one output wheel set 40 carried by pivoting plate 8, and the angular position of this second pivot axis D2 of the at least one output wheel set 40 is variable relative to said first pivot axis D1.

This input wheel set 20 permanently transmits its motion to output wheel set 40, which it moves in a pivoting motion about second pivot axis D2. Lever 100 includes at least, either a first friction connection between a first friction surface 91 of input wheel set 20 and a second friction surface 81 of pivoting plate 8, or a second friction connection between a third friction surface 92 of output wheel set 40 and a fourth friction surface 82 of pivoting plate 8.

It is understood that different variants are achievable, depending on the function to be performed by lever 100.

In a variant, lever 100 includes such a first friction connection between a first friction surface 91 of input wheel set 20 and a second friction surface 81 of pivoting plate 8, and the first friction surface 8 is a bearing surface of revolution 81 of input wheel set 20, and the second friction surface 81 includes the lateral surfaces of a groove 83, 84 bordered by at least one elastic strip 85 and comprised in pivoting plate 8.

In another variant, lever 100 includes such a second friction connection between a third friction surface 92 of output wheel set 40 and a fourth friction surface 82 of pivoting plate 8, and third friction surface 92 is a bearing surface of revolution of output wheel set 40, and fourth friction surface 82 includes the lateral surfaces of a groove 84, 85 bordered by at least one elastic strip 85 and comprised in pivoting plate 8.

In another variant, lever 100 includes such a first friction connection between a first friction surface 91 of input wheel set 20 and a second friction surface 81 of pivoting plate 8, and the first friction surface 91 is elastic, and the second friction surface 81 is rigid.

In another variant, lever 100 includes such a first friction connection between a first friction surface 91 of input wheel set 20 and a second friction surface 81 of pivoting plate 8, and the first friction surface 91 is elastic, and the second friction surface 81 is elastic.

In another variant, lever 100 includes such a first friction connection between a first friction surface 91 of input wheel set 20 and a second friction surface 81 of pivoting plate 8, and the first friction surface 91 is rigid, and the second friction surface 81 is elastic.

In another variant, illustrated by the Figures, lever 100 includes such a second friction connection between a third friction surface 92 of output wheel set 40 and a fourth friction surface 82 of pivoting plate 8 and output wheel set 40 includes at least one corrector wheel plate 15 whose hub carries the third friction surface 92 of output wheel set 40.

More specifically, input wheel set 20 includes at least one intermediate wheel 11 meshing with this corrector wheel plate 15.

In another variant, lever 100 includes such a first friction connection between a first friction surface 91 of input wheel set 20 and a second friction surface 81 of pivoting plate 8, and the at least one first intermediate wheel 11 pivots about an arbor 110 fixed to plate 19, and which carries the first friction surface 91 of input wheel set 20.

In a preferred variant, lever 100 includes both the first friction connection and the second friction connection.

According to the invention, one of said first friction connection and said second friction connection is weaker than the other.

In a variant, the first friction connection is weaker than the second friction connection. In another variant, the second friction connection is weaker than the first friction connection.

The invention also concerns a fast correction mechanism 200, including a plate 19 between a transmitter wheel set 10, which is arranged to cooperate directly or indirectly with control means 17 such as a control stem, a push-piece or similar, and at least one receiver wheel set.

This fast correction mechanism 200 includes such a lever 100 mounted to pivot about a first pivot axis D1.

At least one such receiver wheel set pivots about a third pivot axis D3 distinct from the first pivot axis D1, and is arranged to cooperate with at least one output wheel set 40 carried by lever 100, which constitutes a sliding friction gear.

Preferably, this fast correction mechanism 200 includes, on either side of lever 100, a first receiver wheel set and a second receiver wheel set having distinct pivot axes, and only one of which at most is in mesh, at a given time, with one output wheel set 40 of lever 100.

In a specific application, the first receiver wheel set and the second receiver wheel set are wheels arranged to cooperate, one at a time, with a sliding wheel 61 comprised in output wheel set 40.

In a particular application, as illustrated in the Figures, output wheel set 40 includes at least two stages and carries at least, on two different planes, one corrector finger-piece 14 and one intermediate corrector wheel 12.

In a particular embodiment that is not illustrated, fast correction mechanism 200 includes, between plate 19 and lever 100, at least one elastic return means for subjecting lever 100 to a force tending to pivot it in a preferred direction or for returning it to a rest position.

The motion of the receiver wheel set can be imparted either to pivoting plate 8 of lever 100 or to transmitter wheel set 20 comprised in lever 100.

In a particular embodiment, illustrated by the Figures, the invention concerns a date mechanism 300 including such a fast correction mechanism 200, the first receiver set is a date wheel set or a date correction wheel set, and the second receiver wheel set is a month display mechanism or a month display correction wheel set.

More specifically, date mechanism 300 is an annual calendar mechanism and includes an intermediate wheel including the following integral elements arranged on parallel stages:

- a first intermediate wheel 61 cooperating with an annual wheel 5 comprised in date mechanism 300. This annual wheel 5 is controlled by a date drive wheel set controlled in turn by an hour wheel of a timepiece movement 1000;
- a second intermediate wheel 62 cooperates, at the end of each month, with a lug comprised in a second stage of a date indicator ring 3 driven at a first stage by the date drive mechanism;
- a third wheel 63 including teeth cooperates with a month star wheel 4 mounted for free rotation on the annual wheel. Corrector finger-piece 14 cooperates with date indicator ring 3 to correct the date, and intermediate corrector wheel 12 cooperates with second intermediate wheel 62 to correct the month.

The invention also concerns a timepiece movement 1000 including an hour wheel driving at least one such date mechanism 300 and/or one such fast correction mechanism 200.

The invention also concerns a timepiece 2000, in particular a watch, including at least one such movement 1000 and/or at least one such date mechanism 300 and/or one such fast correction mechanism 200.

Figure 3:
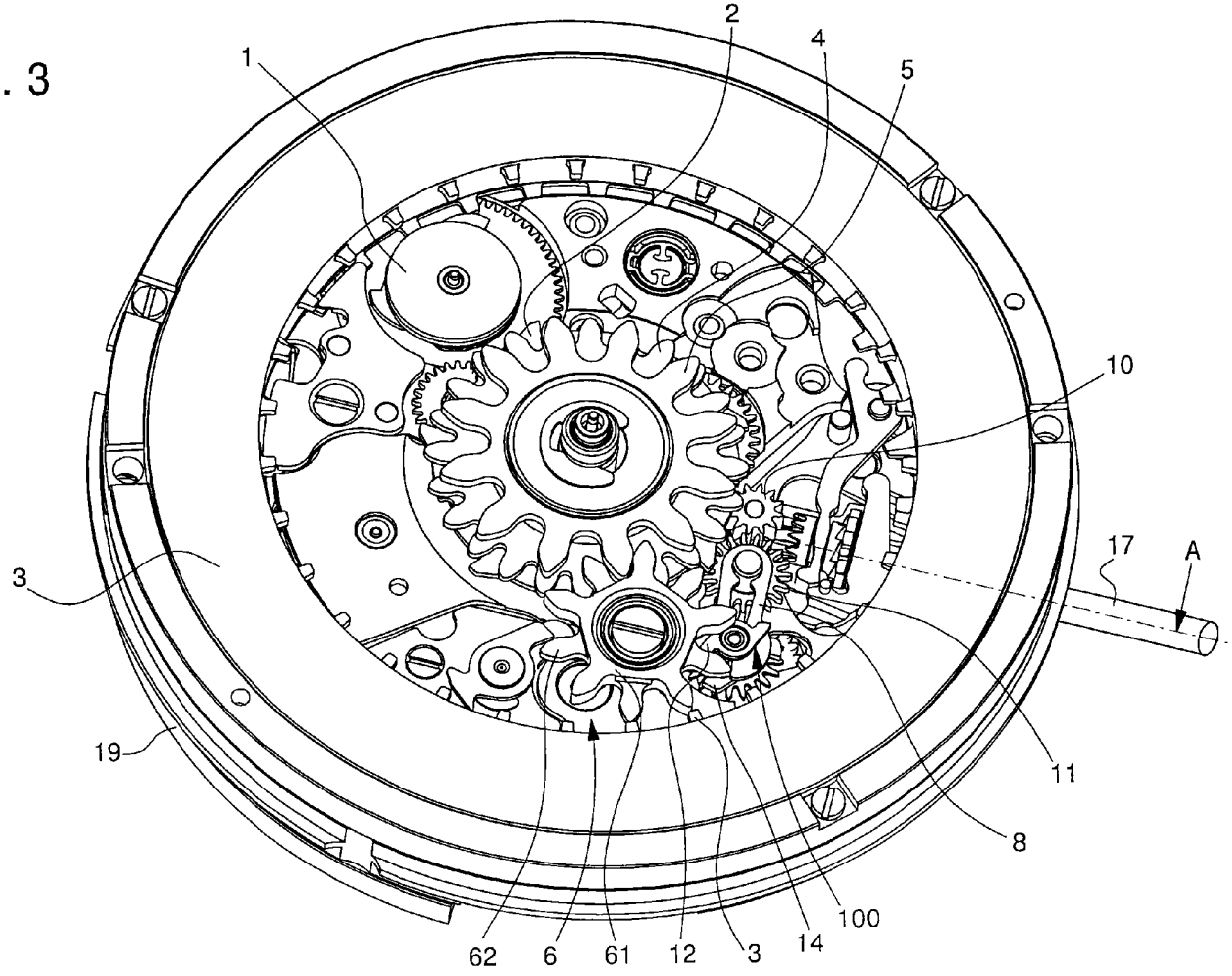
FIG. 3 shows a schematic plan view of a watch movement including a date mechanism and an automatic correction mechanism according to the invention, incorporating the lever of FIG. 1.
Figure 4:
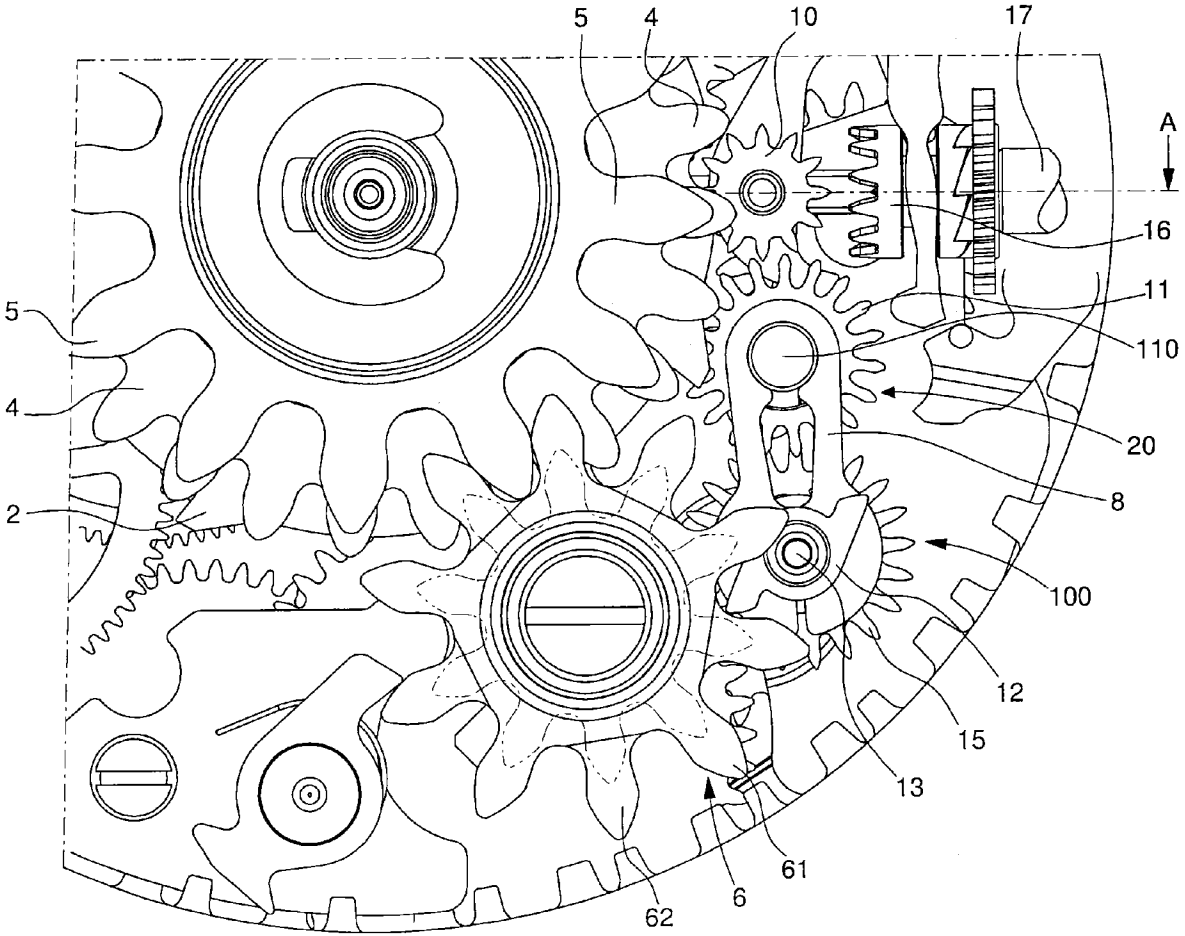
FIG. 4 shows a schematic view of a detail of the mechanism of FIG. 3.
Figure 5:
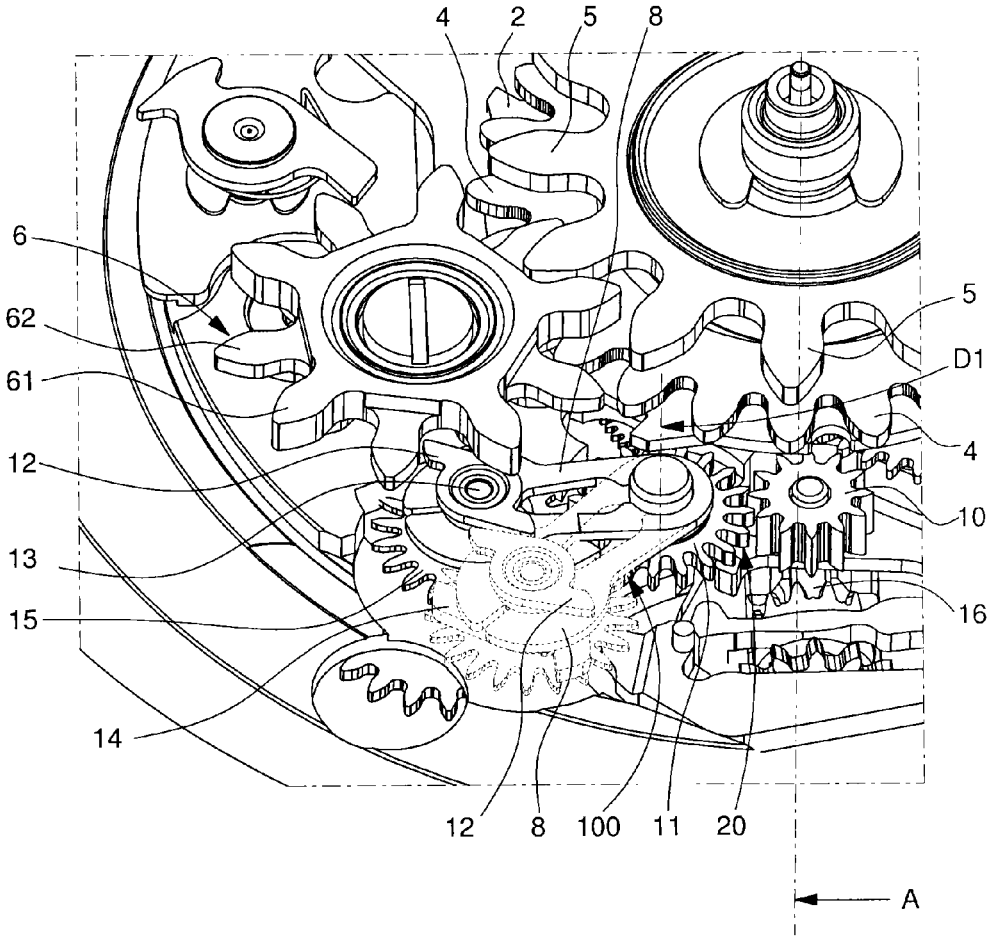
FIG. 5 shows a schematic, perspective view of a detail of the mechanism of FIG. 3 showing the lever in two positions: one position in a thin dotted line shows the cooperation of a corrector finger-piece carried by the lever with a date indicator ring, and the other in a full line shows the cooperation of an intermediate corrector wheel carried by the lever with a second intermediate wheel for correcting the month.
Figure 6:
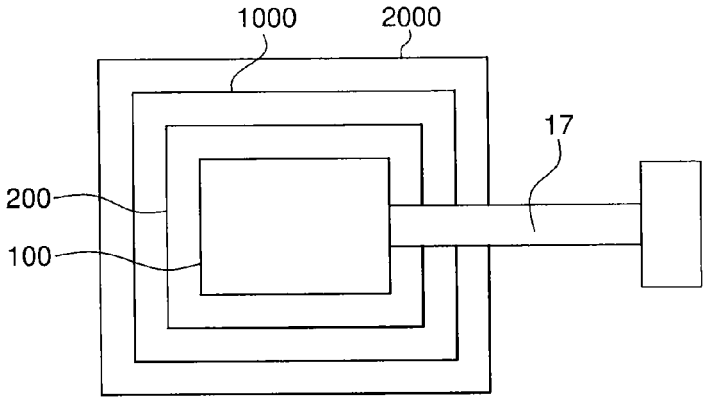
FIG. 6 is a block diagram showing a watch including a movement integrating a fast correction mechanism and a lever according to the invention.

A particular application of the invention, as seen in FIGS. 3 to 5, concerns an annual calendar mechanism as described in Patent No EP1666991B by the same Applicant.

This mechanism includes a date indicator drive wheel 1 provided with two finger-pieces: a first finger-piece which drives once per day a date indicator ring 3 with thirty-one teeth, and a second finger-piece which drives at the end of the months of less than thirty-one days a cam 2 disposed coaxially to a month star wheel 4 comprising 24 teeth.

At the end of the month, date indicator ring 3 drives, by means of a lug, the drive wheel 6 formed of two stages and connecting the month star wheel 4 with 24 teeth and a month disc 5 with 12 teeth. At the end of the months with less than thirty-one days, the finger-piece of the date indicator drive wheel 1 drives cam 2 and month star wheel 4 therefore drives, on the one hand drive wheel 6 and date indicator 3 by means of its lug, and on the other hand month disc 5.

When the user actuates a winding stem 17 to make a fast month correction, the sliding pinion 16 conventionally associated with this stem 17 drives an intermediate wheel 10, which drives an intermediate wheel 11 connecting a sliding friction gear formed by a lever 100 according to the invention, capable of occupying several positions, and allowing a fast correction to be performed.

Lever 100 includes, as described above: a corrector wheel plate 15, a hub 13, a date corrector finger-piece 14 and an intermediate corrector wheel 12, all mounted on a pivoting plate 8 including flexible strips 85 around grooves 83 and 84, these flexible strips 85 being arranged to clamp the hub of certain wheel sets thus establishing a friction connection. This arrangement does not prohibit the simple guiding of the pivoting of a hub, without clamping, inside one of the housings comprised in the pivoting plate and defined by one of inner surfaces 81 or 82.

Corrector wheel plate 15 is mounted on a hub 13 which includes integrally a date corrector finger-piece 14 and an intermediate corrector wheel 12. Corrector spring 8 pivots on the arbor of intermediate corrector wheel 11 and clamps hub 13, driving lever 100 into one of the positions according to the direction of rotation of corrector wheel plate 15 in order to enable drive wheel 6 to correct date indicator 3 or month disc 5. To prevent breakage, hub 13 of the date corrector is held by friction on corrector wheel plate 15, thereby limiting the transmitted torque.

Naturally, other complications can be controlled in a similar manner with the aid of the lever of the invention.

Naturally, although the invention is described within a particular use wherein the input command is given by input wheel set 2 or by pivoting plate 8 to transmit motion to one of the receiver wheel sets, it is clear that such a fast correction mechanism 200 can be used in reverse mode with an output to wheel set 2 or pivoting plate 8.

The invention has multiple advantages:

- the lever can operate without a return spring for its pivoting motion, although naturally such a spring can be added to encourage return to a rest position, or to favour default meshing with one receiver wheel set rather than another;
- in an embodiment including toothed wheels, as illustrated in the Figures, during gearing on one side of the lever or another, the force always tends to push the wheels one against the other, constantly, and good gearing is thus favoured, while also avoiding any inadvertent disengagement or rasping of the system;

when the input transmitter wheel set of the lever is kinematically connected to a stem operated by the user, for example via a sliding pinion, the switching between the two positions occurs under the action of the force imparted by the user to the stem, but with no risk of breaking a component, owing to the friction;

the system is more compact than a friction brake; it allows transmission of high torque compatible with all timepiece functions;

the machining of the pivoting plate of the lever is not complex: its design is well suited to a silicon type realization, by means of MEMS or LIGA or similar processes.

The fast correction system with a sliding friction gear according to the invention is easy to use for any type of fast correction: of the days, months or other.

What is claimed is:

1. A timepiece lever including a pivoting plate carrying an input wheel set mounted to pivot about a first pivot axis, and at least one output wheel set pivoting about a second pivot axis remote from said first pivot axis, said input wheel set fully transmitting its motion, directly or indirectly, to said output wheel set which the input wheel set moves in a pivoting motion about said second pivot axis, said lever including at least a first friction connection between a first friction surface of said input wheel set and a second friction surface of said pivoting plate, and a second friction connection between a third friction surface of said output wheel set and a fourth friction surface of said pivoting plate, wherein one of said first friction connection and said second friction connection is weaker than the other.

2. The lever according to claim 1, wherein said first friction surface is a bearing surface of revolution of said transmitter wheel set and wherein said second friction surface includes the lateral surfaces of a groove bordered by at least one elastic strip and comprised in said pivoting plate.

3. The lever according to claim 1, wherein said third friction surface is a bearing surface of revolution of said output wheel set, and wherein said fourth friction surface includes the lateral surfaces of a groove bordered by at least one elastic strip and comprised in said pivoting plate.

4. The lever according to claim 1, wherein said first friction surface is elastic and wherein said second friction surface is rigid.

5. The lever according to claim 1, wherein said first friction surface is elastic and wherein said second friction surface is elastic.

6. The lever according to claim 1, wherein said first friction surface is rigid and wherein said second friction surface is elastic.

7. The lever according to claim 1, wherein said output wheel set includes at least one corrector wheel plate whose hub carries said third friction surface of said output wheel set.

8. The lever according to claim 7, wherein said input wheel set includes at least one intermediate wheel engaging with said corrector wheel plate.

9. The lever according to claim 8, wherein said at least one first intermediate wheel pivots about an arbor which carries said first friction surface of said input wheel set.

10. A fast correction mechanism between a transmitter wheel set arranged to cooperate directly or indirectly with control means, and at least one receiver wheel set, said transmitter wheel set and said at least one receiver wheel set being arranged on a plate comprised in said fast correction mechanism, wherein said fast correction mechanism includes a lever according to claim 1, mounted to pivot about said first pivot axis, and wherein at least one said receiver wheel set pivots about a third pivot axis distinct from said first pivot axis and is arranged to cooperate with at least one said output wheel set carried by said lever which constitutes a sliding friction gear.

11. The fast correction mechanism according to claim 10, wherein said fast correction mechanism includes, on either side of said lever, a first said receiver wheel set and a second said receiver wheel set having distinct pivot axes, and only one of which at most is in mesh, at a given time, with one output wheel set of said lever.

12. The fast correction mechanism according to claim 11, wherein said first receiver wheel set and said second receiver wheel set are wheels arranged to cooperate, one at a time, with a sliding wheel comprised in said output wheel set.

13. The fast correction mechanism according to claim 10, wherein said output wheel set includes at least two stages and carries at least, on two different planes, one corrector finger-piece and one intermediate corrector wheel.

14. The fast correction mechanism according to claim 10, wherein said fast correction mechanism includes, between said main plate and said lever, at least one elastic return means for subjecting said lever to a force tending to pivot the lever in a preferred direction or for returning the lever to a rest position.

15. The fast correction mechanism according to claim 10, wherein said fast correction mechanism includes means for controlling the motion of said at least one receiver wheel set arranged to impart a motion, either to said pivoting plate of said lever, or to said input wheel set comprised in said lever.

16. A date mechanism including at least one fast correction mechanism according to claim 10, wherein said first receiver wheel set is a date wheel set or a date correction wheel set, and wherein said second receiver wheel set is a month display or a month display correction wheel set.

17. The date mechanism according to claim 16, wherein said date mechanism is an annual calendar mechanism and includes an intermediate wheel including, on parallel stages, a first intermediate wheel cooperating with an annual wheel comprised in said date mechanism, said annual wheel is controlled by a date drive wheel set controlled in turn by an hour wheel of a timepiece movement, a second intermediate wheel cooperating, at the end of each month, with a lug comprised in a second stage of a date indicator ring driven at a first stage by said date drive wheel set, and a third wheel including teeth cooperating with a month star wheel mounted for free rotation on said annual wheel, and said corrector finger-piece cooperating with said date indicator ring for correction of the date, and said intermediate corrector wheel cooperating with said second intermediate wheel for correction of the month.

18. A timepiece movement including an hour wheel driving at least one fast correction mechanism according to claim 10.

19. A timepiece or watch including at least one fast correction mechanism according to claim 10.

* * * * *